United States Patent [19]

Yasuda et al.

[11] Patent Number: 5,028,960

[45] Date of Patent: Jul. 2, 1991

[54] IMAGE DENSITY CONTROL METHOD FOR AN IMAGE FORMING APPARATUS

[75] Inventors: Wataru Yasuda, Yokohama; Moriyuki Koike, Kawasaki; Masaki Tokuhashi; Kouji Ishigaki, both of Yokohama; Yoshihiro Abe, Ichikawa, all of Japan

[73] Assignee: Ricoh Company, Ltd., Tokyo, Japan

[21] Appl. No.: 507,241

[22] Filed: Apr. 10, 1990

[30] Foreign Application Priority Data

| | | | |
|---|---|---|---|
| Apr. 13, 1989 | [JP] | Japan | 1-42476[U] |
| Jun. 22, 1989 | [JP] | Japan | 1-160087 |
| Feb. 7, 1990 | [JP] | Japan | 2-27458 |

[51] Int. Cl.[5] ..... G03G 21/00

[52] U.S. Cl. ..... 355/246; 355/208; 355/214

[58] Field of Search ..... 355/246, 214, 208, 204, 355/245

[56] References Cited

U.S. PATENT DOCUMENTS

| | | | |
|---|---|---|---|
| Re. 32,611 | 2/1988 | Farley | 355/214 X |
| 3,951,541 | 4/1976 | Kuehnle | 355/214 |
| 4,809,039 | 2/1989 | Ishii | 355/246 X |
| 4,833,506 | 5/1989 | Kuru et al. | 355/246 X |
| 4,878,082 | 10/1989 | Matsushita et al. | 355/208 |

*Primary Examiner*—A. T. Grimley
*Assistant Examiner*—Sandra L. Hoffman
*Attorney, Agent, or Firm*—Oblon, Spivak, McClelland, Maier & Neustadt

[57] ABSTRACT

An image density control method for an image forming apparatus of the type forming a latent image of a document image on a photoconductive element and developing the latent image to form a toner image by an electrophotographic procedure. A background pattern is implemented as a light pattern having a low density and provided independently of a reference density pattern. The light pattern is illuminated to form a latent image thereof on the photoconductive element, and the latent image is developed by a toner. The density of the resultant toner image is sensed by an image density sensor. Such a procedure allows a change in background density ascribable to contamination, increase in background potential and so forth to be detected. The light pattern may be replaced with a leading edge portion of a document if the leading edge portion has a density corresponding to the background density. Then, the latent image of the background pattern will be formed under exactly the same conditions as the latent image of an ordinary image, i.e., without any limitations as to the position of the pattern.

6 Claims, 5 Drawing Sheets

IMAGE DENSITY CONTROL METHOD FOR AN IMAGE FORMING APPARATUS

BACKGROUND OF THE INVENTION

The present invention relates to an image density control method for an image forming apparatus of the type forming a latent image representative of a document image on a photoconductive element and developing the latent image to produce a toner image by an electrophotographic procedure.

A predominant type of copier or similar image forming apparatus which is implemented by an electrophotographic procedure uses a two component developer, i.e. the mixture of a toner and a carrier. In this type of copier, for example, as the toner is consumed by the repetitive copying process, the toner concentration in the developer is sequentially reduced to in turn lower the density of the resultant toner image. It has been customary, therefore, to supply a supplementary amount of toner to the developer to maintain the density of the developed image constant. In an automatic density control mode, a desired or target image density is associated with the density of a document image which is sensed by a document density sensor. On the other hand, in a manual density control mode, the target density is associated with a particular image notch manually selected on an operation board of the copier. Generally, the first to seventh notches are available with a copier, and the image density decreases with the increase in the notch number. For this kind of image density control, use may be made of a reference density pattern having a reference density, as well known in the art. Specifically, a latent image representative of the reference density pattern is formed on a photoconductive element and then developed by the toner, every time a predetermined number of copies are produced. Then, an image density sensor (sometimes referred to as a P sensor) optically senses the density of the resultant toner image. The sensed image density is fed back to a toner supply section of a developing device included in the copier to supply an adequate amount of toner, whereby the image density is maintained constant. This method determines a change in the toner concentration of the developer, i.e., a change in the proportion of the toner to the carrier in terms of a change in the density of the toner image of the reference pattern formed on the photoconductive element, thereby controlling the toner concentration of the developer. While a reflection from the reference density pattern is weak when the toner concentration is high, it becomes intense as the toner density decreases. The reference voltage of the image density sensor or P sensor (surface potential of the photoconductive element developed by an eraser) is usually selected to be 4 V. Then, when the output of the sensor associated with the reference density pattern is higher than 0.5 V which is one-eighth of 4 V and representative of an adequate toner concentration, the toner is determined to be short and, therefore, it is supplied. When the output of the sensor is lower than 0.5 V, the toner is determined to be sufficient and not supplied at all.

The surface potential of the photoconductive element sequentially increases with the number of copies produced. In addition, mirrors and a glass platen incoporated in the machine are contaminated by toner particles and silicone oil which is used to fix a toner image on a paper sheet and vaporizes, resulting in the decrease in the amount of light and, therefore, in the increase in the potential of light areas. By such an increase in the surface potential of the photoconductive element, the image density adequately adjusted at first is shifted to the dark side with the result that the background is disturbed.

To eliminate the drawback of the toner supply control scheme stated above, there has also been proposed a method which substantially variably controls the developing ability by controlling the total current to be fed to a charger which charges the photoconductive element, the bias voltage for development to be applied to a developing sleeve of the developing device, the voltage to be applied to a lamp of optics, etc., or by relying on the user's manual correction. Such an approach is also successful in setting up a desired image notch and disclosed in, for example, Japanese Patent Laid-Open Publication (Kokai) Nos. 61-128269, 62-280871 and 54-134635, and U.S. Pat. No. 4,618,248.

A photoconductive element for use in an electrophotographic copier or similar image forming apparatus is often implemented by $As_2Se_3$ which is an inorganic compound of selenium and a small amount of arsenic. This kind of photoconductive element has the highest sensititivity. The surface of $As_2Se_3$ is coupled with oxygen existing in the air to form an AsO (arsenic oxide) layer, whereby a charge is retained on the photoconductive element. This brings about a problem that the charge retaining ability depends on the condition of the AsO layer. Since an $As_2Se_3$ photoconductive element has hardly any charge retaining ability just after evaporation, it is left in the dark until the charge retaining ability reaches saturation. However, about three to six months are needed for the charge retaining ability to reach saturation. This results in the need for a considerable amount of stock and, therefore, in low productivity. To accelerate such a procedure, i.e., to reduce the period of time over which the photoconductive element should be left in the dark, the element just undergone evaporation may be loaded in a copier, then run with paper sheets for a test for about five to fifteen minutes, and then left in the dark. In practice, however, a copier is put on the market without its photoconductive element being left in the dark for such a sufficient period of time, and it is actually operated before the element attains the expected charge retaining ability. While a serviceman usually tests a new copier for about 5 minutes on the delivery of the machine to a user in order to provide it with as great a charge retaining ability as possible, such a measure is not satisfactory. With a copier having an $As_2Se_3$ photoconductive element, it usually occurs that after the installation of the copier the potential (background potential) of the element increases by about 90 V when about 1,000 copies are produced, i.e., on the lapse of about one to three months. Such an increase in the potential shifts the entire image to the dark side and thereby contaminates the background, often constituting the cause of serviceman call.

Optics built in a copier is generally made up of a glass platen, mirrors, a lens, a dust glass, and an arrangement for cooling the entire optics. When various contaminants such as dust floating in the air, the vapor of oil filling the machine and toner particles deposit on the mirrors and other components of the optics, the transmittance and/or reflectance of the entire optics is lowered to reduce the quantity of light available for imagewise exposure. Especially, the prior art automatic density type control method does not take account of the deposition of such contaminants, i.e., the decrement of the amount of light, so that the entire image is shifted to the dark side. For example, assuming that maintenance cycle a copier is about 80,000 copies, the decrement of the quantity of light corresponds to about 100 V to 200 V in terms of the potential of the photoconductive element. Hence, the density is brought out of the automatic control range, constituting another cause of serviceman call. The shift of the potential of the photoconductive element to the dark side as stated above means that the background potential of the element is changed to contaminate the background.

The conventional image density control of the kind using an image density sensor or P sensor does not give any consideration to the problems discussed above, i.e., it simply controls toner supply in such a manner as to maintain the developing ability constant. Hence, the image density is prevented from matching a selected image notch. This is also true with the alternative approach shown and described in any of the previously mentioned Laid-Open Publications. Specifically, the alternative approach replaces one variable factor capable of changing the developing ability with another variable factor when the former reaches a predetermined value. However, it does not detect a change in the density of the background and, therefore, cannot automatically deal with the background contamination ascribable to the shift of the potential of the photoconductive element to the dark side.

SUMMARY OF THE INVENTION

It is therefore an object of the present invention to provide an image density control method for an image forming apparatus which corrects the deviation of an image notch and thereby allows an image to have an adequate density matching a desired image notch.

It is another object of the present invention to provide an image density control method which corrects the developing ability by detecting a change in the background density of an image, thereby eliminating the contamination of the background.

It is another object of the present invention to provide an image density control method for an image forming apparatus which promotes accurate detection of a change in the background density of an image.

It is another object of the present invention to provide an image density control method for an image forming apparatus which allows the latent image of a background pattern to be formed under exactly the same conditions as the latent image of a usual document image by replacing an exclusive light pattern with a leading end portion of a document which corresponds in density to to the background.

It is another object of the present invention to provide a generally improved image density control method for an image forming apparatus.

In accordance with the present invention, in an image density control method for an image forming apparatus for illuminating, in an electrophotographic process, a reference density pattern having a reference density to electrostatically form a latent image of the reference density pattern on a uniformly charged photoconductive element, developing the latent image by a toner-containing two-component developer to form a toner image, optically sensing the density of the toner image, and controlling the developing ability on the basis of the detected density to maintain the developing ability constant, the reference density pattern and a background pattern having a low density are provided at opposite sides of the same scanning line which lies in a scanning range of the scanner. A latent image representative of a background pattern whose density corresponds to a background density of a document image is electrostatically formed on the photoconductive element. The latent image of the background pattern is developed by the developer to form a toner image. The density of the toner image associated with the background pattern is optically sensed. A change in the background density is detected in response to the sensed density of the toner image associated with the background pattern. The developing ability is corrected in response to the detected change in the background density.

Also, in accordance with the present invention, in an image density control method for an image forming apparatus for illuminating, in an electrophotographic process, a reference density pattern having a reference density to electrostatically form a latent image of the reference density pattern, developing the latent image by a toner-containing two-component developer to form a toner image, optically sensing the density of the toner image, and controlling the developing ability of the basis of the detected density to maintain the developing ability constant, a document image density sensor for sensing a density of a document image is provided. The density of a leading edge portion of a document image is sensed by the document image density sensor. Whether or not the sensed density of the leading edge portion of the document image corresponds to a background density is determined. If the sensed density corresponds to the background density, the leading edge portion is illuminated by the scanner to electrostatically form a latent image of the leading edge portion on the photoconductive element. The latent image of the background pattern is developed by the developer to form a toner image. The density of the toner image associated with the background pattern is optically sensed. A change in the background density is detected in response to the sensed density of the toner image associated with the background pattern. The developing ability is corrected in response to the detected change in the background density.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
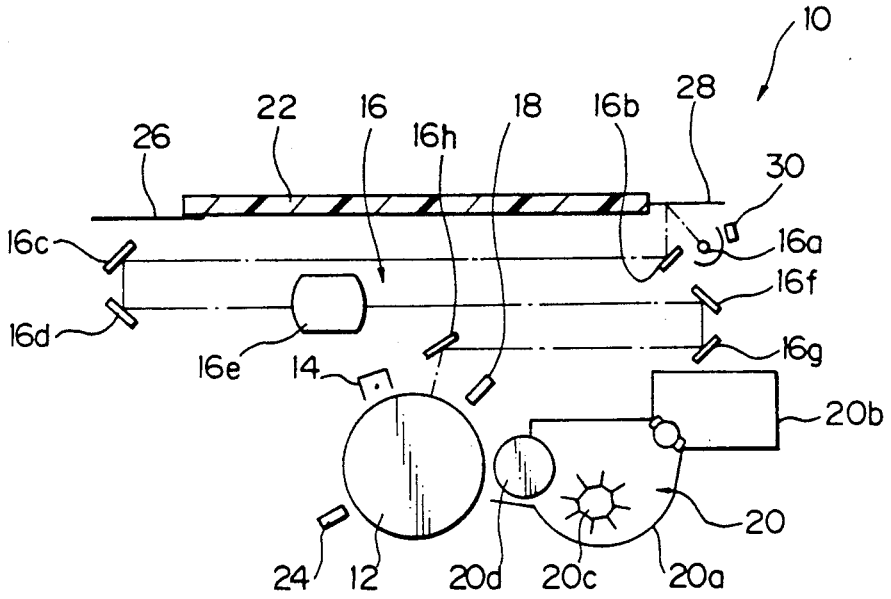
FIG. 1 is a fragmentary section showing an electrophotographic copier belonging to a family of image forming apparatuses to which the present invention is applicable.

To better understand the present invention, a brief reference will be made to the general construction of an image forming apparatus to which the present invention is applicable, shown in FIG. 1. In the figure, the image forming apparatus is implemented as an electrophotographic copier by way of example and generally desgnated by the reference numeral 10. As shown, the copier 10 has a photoconductive element in the form of a drum 12. The drum 12 may be made of $As_2Se_3$ and have a diameter of 80 millimeters. Arranged around the drum 12 in sequence are a charging device 14 implemented by a charger, an exposing device 16, an eraser 18, and a developing device 16 for executing a predetermined electrophotographic procedure.

The exposing device 16 has a glass platen 22 to be loaded with a document, not shown. While a lamp 16*a* illuminates a document laid on the glass platen 22, a reflection or image light from the document is steered by a first mirror 16*b*, a second mirror 16*c* and a third mirror 16*d* to a lens 16*e*. The image light coming out of the lens 16*e* is further steered by a fourth mirror 16*f*, a fifth mirror 16*g* and a sixth mirror 16*h* to the drum 12 to expose the drum 12 imagewise. The lamp 16*a* and first mirror 16*b* constitute a first scanner, while the second mirror 16*c* and third mirror 16*d* constitute a second scanner. The first scanner moves in the same direction as the second scanner and at a twice higher speed than the latter. In FIG. 1, the first and second scanners have a home position defined at the left-hand side of the glass platen 22 and a return position defined at the right-hand side of the same. The developing device 20 uses a two-component developer, i.e., the mixture of a carrier and a toner. The developing device 20 has a casing 20*a*, a toner tank 20*b*, an agitator 20*c* and a developing sleeve 20*d*. The developing sleeve 20*d* has a diameter of 41 millimeters and adjoins the drum 12. A DC power source Vb is connected to the developing sleeve 20*d* for supplying a bias voltage for development to the sleeve 20*d*.

A first embodiment of the image density control method in accordance with the present invention will be described hereinafter.

In the first embodiment, the supply of toner is controllably varied in matching relation to the image density on the drum 12 so as to stabilize the developing ability of the developing device 20. In order to implement such variable control, use is made of a reference density pattern 26 having a reference density, and an image density sensor 24 comprised of a reflection type photosensor (sometimes referred to as a P sensor 24 hereinafter). The image density sensor 24 optically senses the density of a toner image formed on the drum 12 and representative of the reference density pattern 26, so that the toner supply is controlled in response to an output of the sensor 24 to maintain the image density constant. The reference density pattern 26 is provided on the leading end of the glass platen 22 (on the home position side) and illuminated by the optics 16 before the document. A latent image representative of the reference density pattern 26 is formed on the drum 12 and then developed by the developing device 20 to form, for example, a black solid image pattern on the drum 12. This image pattern is so positioned on the drum 12 as not to overlap with a document image.

In this particular embodiment, a toner image representative of a background pattern is formed on the drum 12 in addition to the toner image, or black solid image, associated with the reference density pattern 26. Specifically, a light pattern 28 is provided on the trailing end of the glass platen 22 (on the return position side) to serve as the background pattern, while the optics 16 is constructed to scan the light pattern 28 as well.

Figure 2:
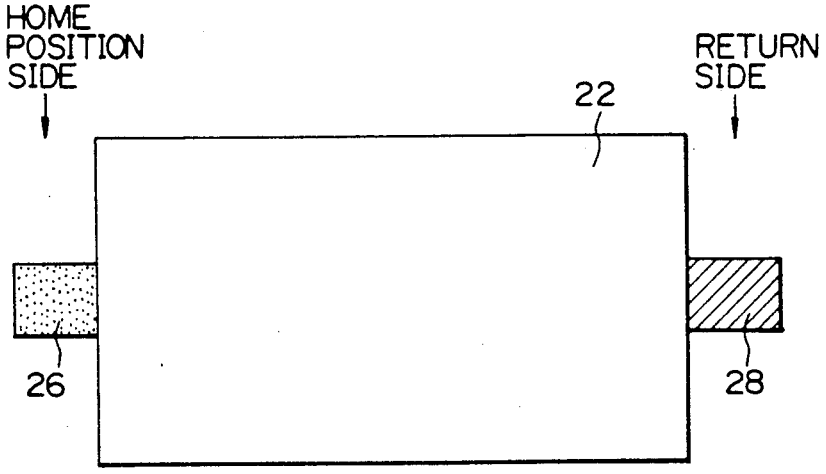
FIG. 2 is a plan view showing a reference density pattern and a light pattern which serves as a background pattern.

The reference density pattern 26 and light pattern 28 will be described in more detail with reference to FIG. 2. The reference density pattern 26 having a high density is located on the home position side as previously stated, because it is used not only during full scanning operation but also during other operations. On the other hand, the light pattern 28 having a low density is located on the return position side remote from a fixing unit in order to prevent the vapor of silicone oil which is produced in a fixing unit from depositing on the light pattern 28. Should the patterns 26 and 28 be positioned side by side, the light pattern 28 would be illuminated as frequently as the reference density pattern 26 and, therefore, easily fade to effect the accuracy of background density detection. In this respect, too, locating the light pattern 28 on the return position side is desirable. In order that a single image density sensor, i.e., the P sensor 24 may sense the densities of the toner images representative of the two patterns 26 and 28, the patterns 26 and 28 are positioned on the same scanning line, as shown in FIG. 2. Preferably, the document density sensor 30 is located on the same axis as the P sensor 24.

Figure 3:
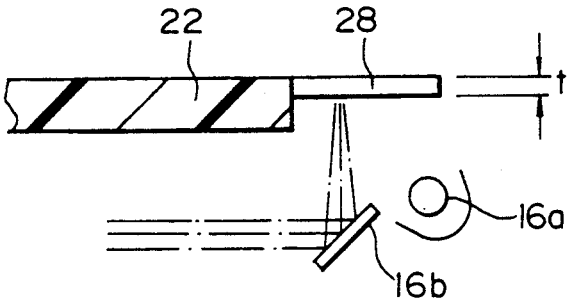
FIG. 3 is an enlarged section of a part of the copier shown in FIG. 1.

More specifically, as shown in FIG. 3, the light pattern 28 is located in a position where it is shifted by a dimension t of about 2 millimeters relative to the surface of a document, i.e. the surface of the glass platen 22. Optically, therefore, the light pattern 28 is flush with the surface of the ordinary glass platen 22. This maintains the surface of the glass platen 22 and that of a document equal to each other as to the condensing rate.

Figure 4:
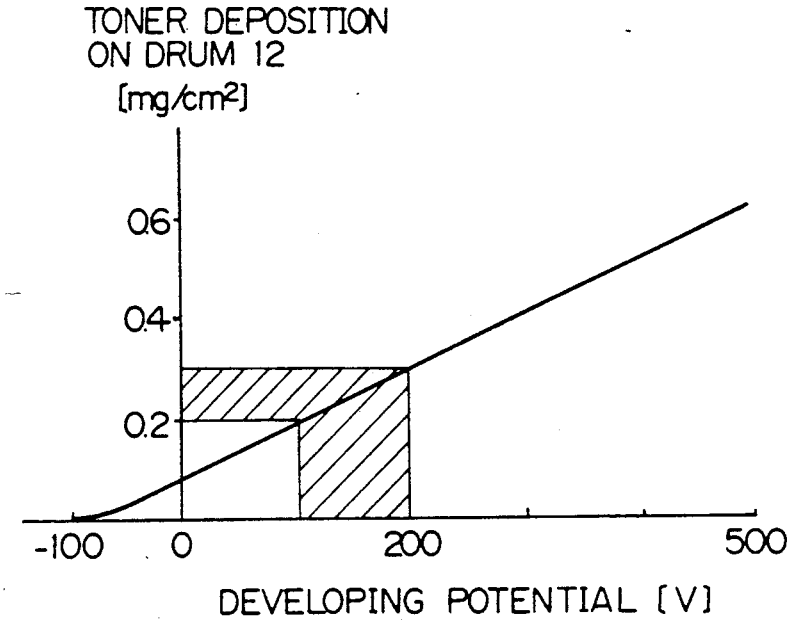
FIG. 4 is a graph indicative of a relationship between the developing potential and the amount of toner deposition on a photoconductive element.

The density of the toner image representative of the light pattern or background pattern 28 is also sensed by the image density sensor or P sensor 24. Basically, it is preferably that the density of the light pattern 28 be equivalent to that of the background, i.e., about 0.08 to 0.1 in order to free the background from contamination. In the illustrative embodiment, however, the density of the light pattern 28 is selected to be slightly higher than that of the background by taking account of the loss ascribable to the glass platen, the irregularity in the level or height of the light pattern 28 and in the density of the pattern itself. Specifically, the light pattern 28 has a density lying in the range of about 0.2 to about 0.3, as indicated by hatching in FIG. 4. Regarding the latent image of such a light pattern 28, should the bias voltage applied to the developing sleeve 20*d* for development be 290 V (associated with the reference density which is the fourth notch), the developing potential would be too low to allow a sufficient amount of toner to deposit on the latent image and, hence, it would be difficult for the P sensor 24 to sense the resultant image. In the light of this, the embodiment lowers the usual bias voltage in the event of development of the light pattern 28, thereby promoting the deposition of toner. Specifically, as shown in FIG. 4, since the latent image representative of the light pattern 28 has a potential of bout 150 V to 250 V, the bias voltage for development is selected to be about 50 V to 100 V to insure a developing potential of 100 V to 200 V.

In the illustrative embodiment, the image density control is executed on two different occasions, i.e., when the image is to be adjusted by a serviceman and when the image density is to be corrected, as follows.

Figure 5:
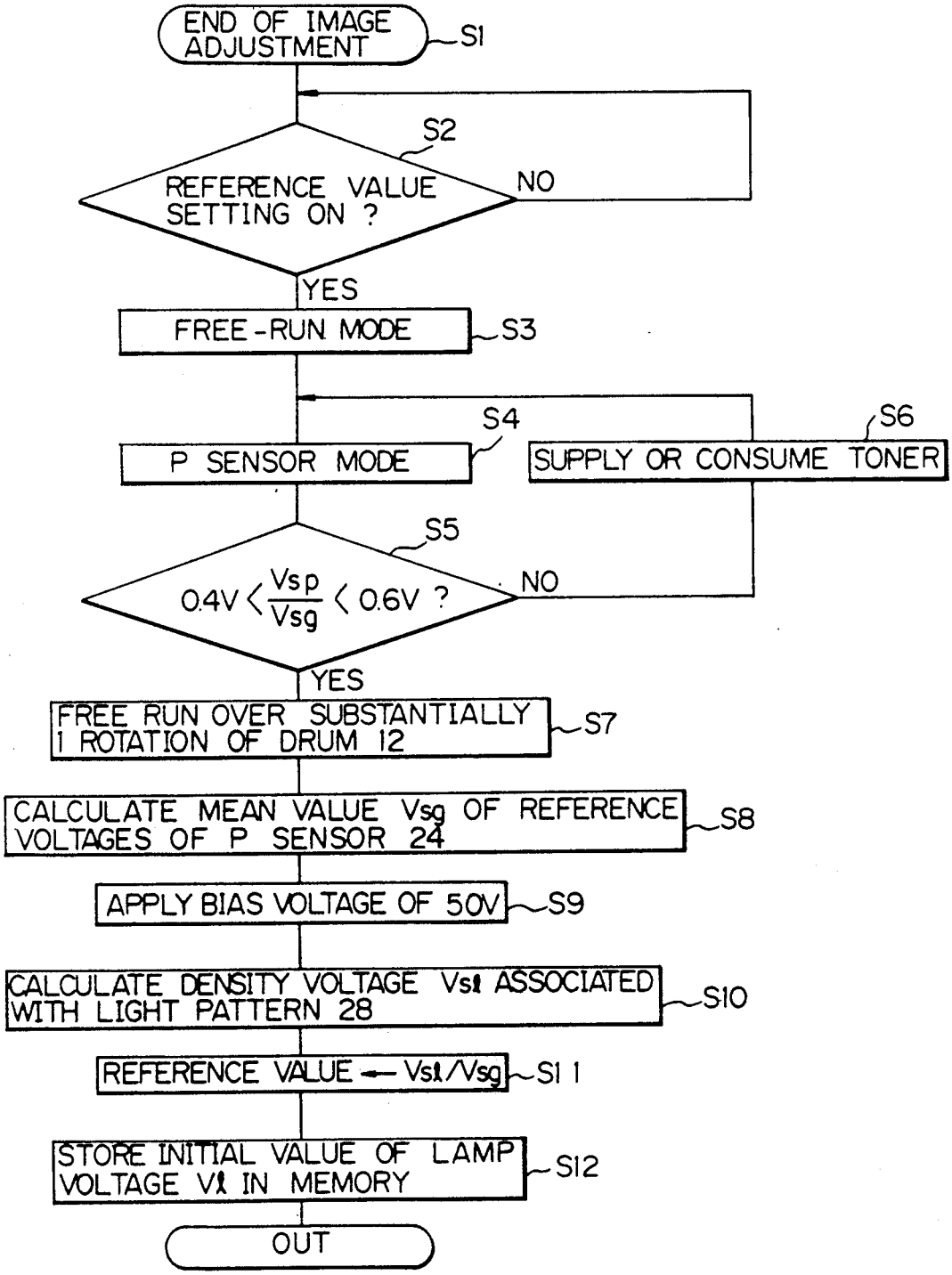
FIGS. 5 and 6 are flowcharts demonstrating specific control operations in accordance with a first embodiment of the present invention.

First, a reference will be made to FIG. 5 for describing the image density control associated with the serviceman's image adjustment. The processing shown in FIG. 5 will be executed when the image forming apparatus, or copier, 10 is delivered to a user and at the time of periodic maintenance, replacement of the drum 12, and so forth in order to set a reference value. After the serviceman has completed image adjustment (step S1), a reference value set mode is set up either automatically or in response to the operation of an exclusive button (step S2). At this instant, in order to maintain the condition (charge retaining ability) of the drum 12 constant at all times, the copier 10 is operated in a free-run mode over a predetermined period of time (step S3). When the drum 12 is made of $As_2Se_3$, the free-run mode should preferably be continued over a period of time associated with about twenty copies. Thereafter, a latent image of the reference density pattern 26 is electrosatically formed on the drum 12 and then developed by the toner. A reflection from the resultant toner image is sensed by the P sensor 24. This part of the sequence following the step S3 is collectively represented by a step S4, or P sensor mode, in the figure. Whether or not the density Vsp of the toner image sensed by the P sensor 24 lies in a predetermined range relative to a toner supply reference value of 0.5 V, i.e. in the range of ±0.1 V is determined (step S5). It is to be noted that the reference value of 0.5 V stems from the previously stated relation of $Vsp/Vsg=\frac{1}{8}$. Specifically, when the sensed value Vsp greatly differs from the reference value such as just after or just before the toner supply, it is likely that an error occurs even after the correction. If the sensed value Vsp is greater than the reference value of 0.5 V by more than 0.1 V, i.e., if it is greater than 0.6 V, the toner is supplied. If the sensed value Vsp is lower than 0.5 V by more than 0.1 V, i.e., if it is less than 0.4 V, the black image is automatically formed on the drum 12 in order to control the sensed value Vsp to the target range which is greater than 0.4 V and smaller than 0.6 V. Such a sequence of steps is represented by a step S6 in the figure.

On condition that the sensed image density which is one of the factors dictating the developing ability remains stable within the above-stated particular range, the program enters into operations for detecting a change in background density and correcting the reference value. First, the copier 1 is operated in a free-run mode to rotate the drum 12 over substantially one full rotation (step S7) and to thereby cause the eraser 18 to form a contamination-free region over substantially the entire circumference of the drum 12. Then, the reference voltage Vsg (=4 V) associated with the P sensor 24 is determined as a mean value of input data obtained from a hundred equally divided portions of the surface of the drum 12 (step S8). Subsequently, the scanner including the lamp **16*a* and having been moved to a position just below the light pattern 28 is brought to a stop, and then the lamp 16*a* is turned on to form a latent image representative of the light pattern 28 on the drum 12. This latent image is developed under the application of a bias voltage of 50 V to thereby form a toner image over substantially the entire circumference of the drum 12 (step S9). The density of the toner image associated with the light pattern 28 is also sensed by the P sensor 24, whereby a voltage Vsl representative of the density associated with the light pattern 28 (target being 2 V) is determined on the basis of the data associated with the hundred divided portions of the drum 12 (step S10). The voltage Vsl is divided by the voltage Vsg, and the resultant voltage Vsl/Vsg is written to a memory as a correction reference value for the P sensor 24 (step S11). Also written to the memory is the initial value of a voltage Vl which is applied to the lamp 16*a* (step S12**). In this manner, the reference values which will be used for the next correction are set while the developing ability remains stable within the predetermined range.

Figure 6:
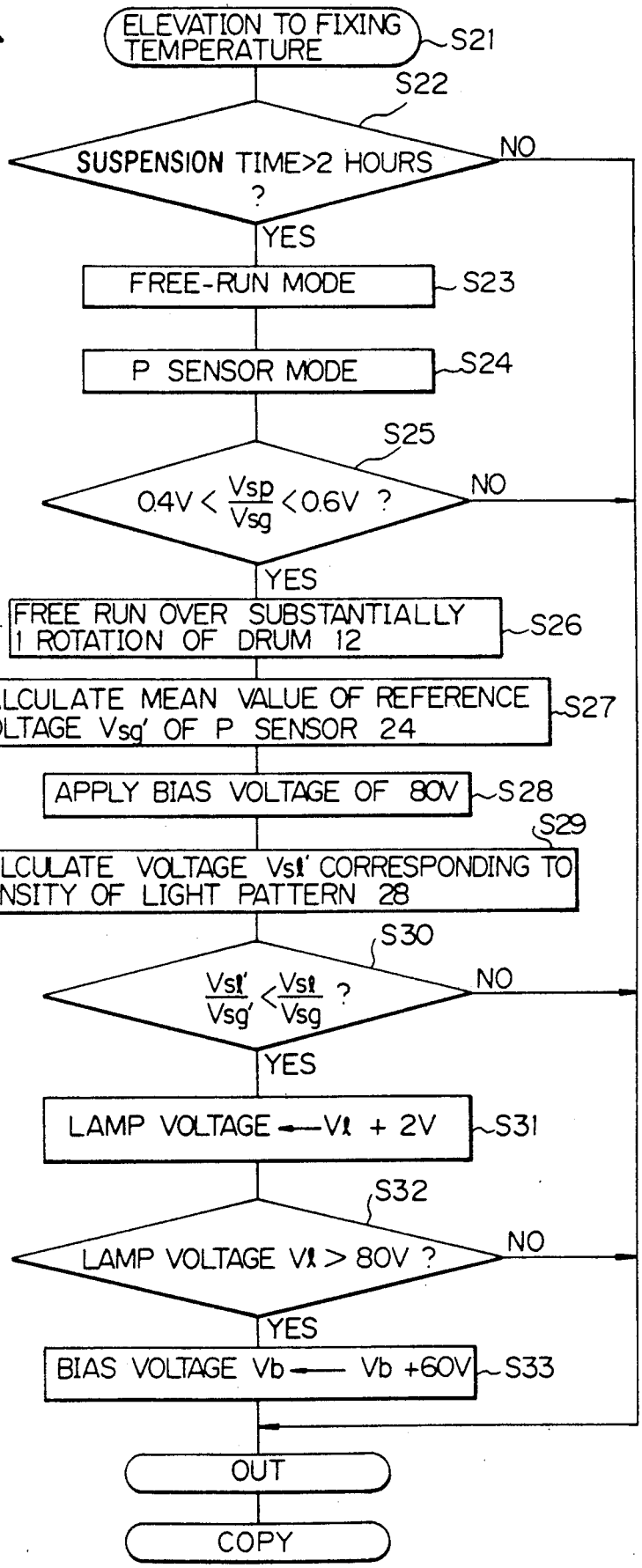

The density control to be effected at the time of image density correction will be described with reference to FIG. 6. In this particular embodiment, whether or not two hours of suspension has expired after the rise of the fixing temperature to a predetermined value is determined every morning (step S22). Every time 2 hours expires, the developing ability is corrected. Specifically, after the rise of the fixing temperature to the predetermined value, the copier 12 is operated in a free run mode over a period of time associated with twenty copies in order to reduce the irregularity in the conditions of the drum 12 (step S23). This free-run mode operation is executed over 30 seconds with the entire eraser 18 being turned on and with the lamp **16*a* being turned off. Then, the density is sensed as to the reference density pattern 26 in an ordinary P sensor mode to thereby determine the developing ability of the developing device 5, in the same manner as when the reference value is set as stated previously (step S24). Again, whether or not the voltage representative of the sensed density is higher than 0.4 V and lower than 0.6 V is determined to see if the developing ability is stable (step S25). If the answer of the step S25 is YES, the program advances to a step S26**. If otherwise, i.e., if the voltage is greatly deviated from the predetermined range, the correction is prolonged to the next day or the reference value for correction is shifted. In any case, the toner is automatically supplied or consumed to control the actual voltage to the target value of 0.5 V plus or minus 0.1 V.

In the step S26, a free-run mode operation is executed over substantially one full rotation of the drum 12. Then, a mean value of reference voltages Vsg' of the P sensor 24 is determined (step S27). This is followed by a step S28 for adding 30 v, or one half of a notch, to 50 V which is the reference bias voltage, whereby a bias voltage of 80 V is applied as a bias voltage for development associated with the light pattern 28 (one of variable factors dictating the developing ability) (step S28). In response to the output of the P sensor 24, a voltage V'sl representative of the density of the toner image of the light pattern, or background pattern, 28 is detected on the basis of the mean value of the input data obtained from the hundred divided portions (step S29). The ratio of the detected voltage V'sl to the voltage V'sg previously detected in the step S27, i.e., V'sl/V'sg is compared with the reference ratio Vsl/Vsg (step S30). When the ratio V'sl/V'sg is smaller than the ratio Vsl/Vsg, meaning a shift of the entire image to the high density side, a feed-back by about one notch is effected to the voltage to be fed to the lamp **16*a*, the bias voltage to be applied to the developing sleeve 20*d*, the current to be fed to the charger 14**, or similar variable factor associated with the developing ability. This corresponds to a shift of one step having any suitable width and effected within the range of one notch relative to the initial value. As FIG. 6 indicates, in the illustrative embodiment, the above-mentioned one notch of feedback is effected to the quantity of light (lamp voltage Vl) in order to reduce the amount of change on an image as far as possible, i.e., the lamp voltage Vl is increased by about 1 V to about 3 V at a time (step 31). The increment of the lamp voltage Vl is shown as being 2 V by way of example. It is noteworthy that the correction is effected only by one notch at each time of detection for the purpose of preventing the correction from running away. However, since the lamp voltage Vl has a certain upper limit due to the standards, it may be replaced with the bias voltage for development, charging current or similar factor on reaching its upper limit. Hence, the correction width is not limited in practice. In this embodiment, assuming that the upper limit of the lamp voltage V1 is 80 V, whether or not the lamp voltage V1 has reached 80 V as a result of the correction is determined (step S32). If the answer of the step S32 is YES, the subject of the correction is switched over from the lamp voltage V1 to the bias voltage, i.e., the reference bias voltage Vb is increased by 60 V (step S33). More specifically, the increment of 60 V of the bias voltage or the decrement of 8% of the charging current in terms of the total current each corresponds to one notch. The procedure for switching over the subject of the correction as stated above is disclosed the previously stated Japanese Patent Laid-Open Publication Nos. 61-128269 and 62-280871, for example. The corrected values will be sequentially updated thereafter as new developing conditions and the initial values for the next correction, thereby producing developed images the background of which is free from contamination. For example, assuming that the background potential of the drum 12 has been shifted to the dark side, the lamp voltage V1 or the like will be substantially corrected to the light side. The developing ability is, therefore, variably controlled with the variation in backgroung density being taken into account. This is successful in minimizing the contamination on the background of an image, i.e., in producing an image whose density accurately matches the selected image notch.

Figure 7:
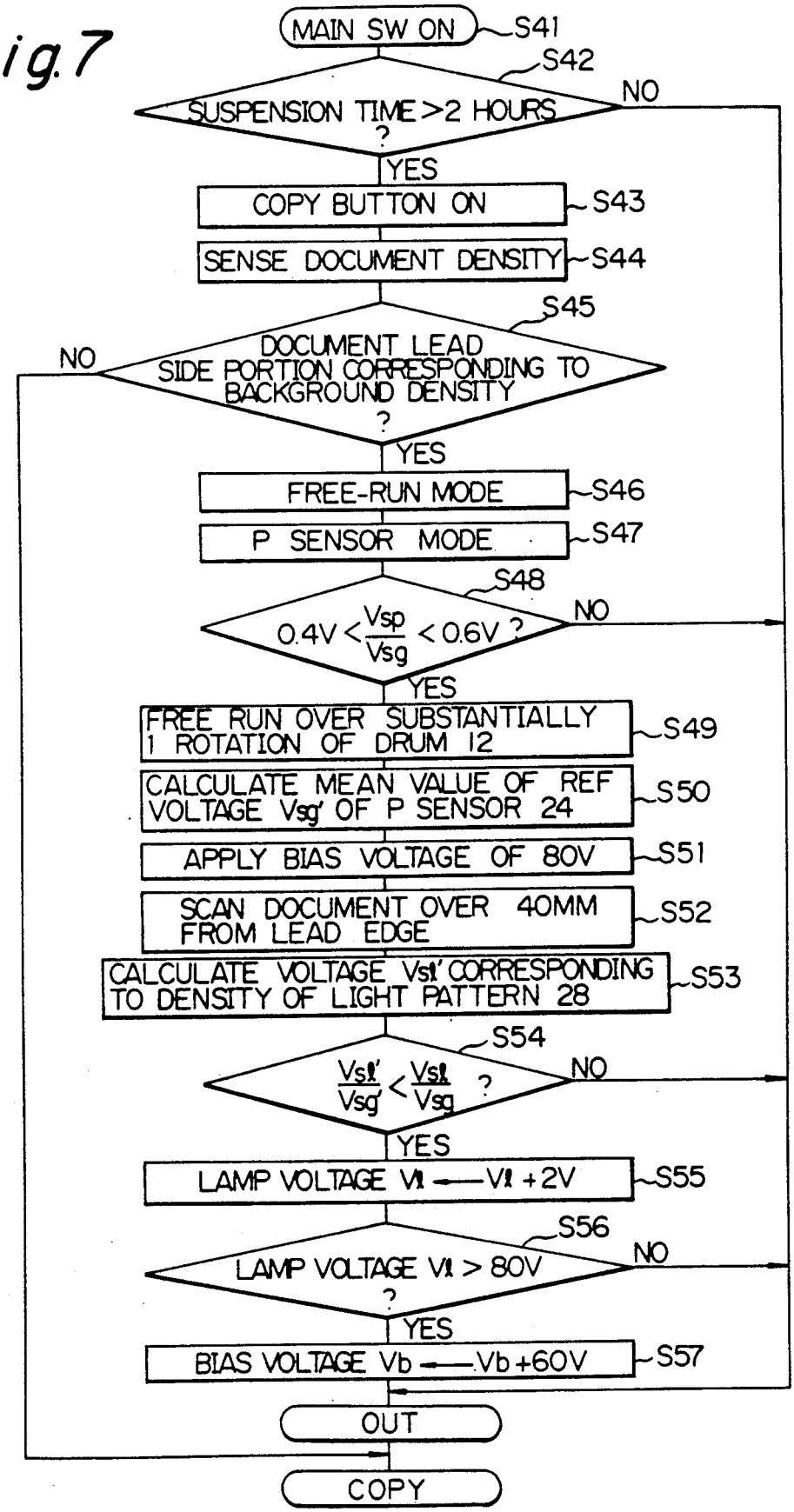
FIG. 7 is a flowchart demonstrating a specific operation in accordance with an alternative embodiment of the present invention.

Referring to FIG. 7, an alternative embodiment of the image density control method in accordance with the present invention will be described. In the figure, similar components and structural elements are designated by like reference numerals, and redundant description will be avoided for simplicity. In the embodiment described previously, the light pattern 28 is illuminated by the optics 16 in order to form the latent image of a background pattern. A prerequisite with such a scheme is that the light pattern 28 be shifted by the dimension t of about 2 millimeters relative to the surface of a document so as to be optically flush with the surface of the glass platen 22, as stated previously with reference to FIG. 3. The previous embodiment, therefore, suffers from strict limitations as to the space and the position of the light pattern 28. In the alternative embodiment, during automatic density or ADS mode operation, the document image sensor 30 movable along with the lamp 30 and adapted for automatic density control is used in place of the extra pattern 28. Specifically, if, among the densities of a document sensed by the document density sensor, the density of a leading edge portion of the document lies in a range corresponding to the background density, the leading edge portion of the document is substituted for the light pattern 28 and illuminated to form the latent image of a background pattern. Such a latent image can be formed under exactly the same conditions as the latent image of an ordinary document, i.e., optically at the same position as the surface of the glass platen 22. This eliminates the strict limitations particular to the light pattern 28 of the previous embodiment. The latent image of a background pattern formed by illuminating a leading edge portion of a document is developed by a toner, and the density of the resultant toner image is also sensed by the P sensor 24. The acceptable density of a leading edge portion of a document, like the density of the light pattern 28, should preferably range from about 0.08 to about 0.1 corresponding to background density in order to eliminate the contamination of the background. However, a somewhat higher density than 0.08 to 0.1 may be selected, if desired.

Again, the control is effected on two different occasions, i.e., at the time of image adjustment by a serviceman and at the time of image density correction. The control associated with the image adjustment by a serviceman proceeds in the same manner as the sequence of steps shown in FIG. 5.

A reference will be made to FIG. 7 for describing the control associated with the other occasion, i.e. image density correction. This control is in principle similar to the control shown in FIG. 6. In FIG. 7, when a copy button is pressed (step S43), the document image sensor 30 senses a density distribution of a document laid on the glass platen 22 (step S44). Then, whether or not the density of a leading edge portion of the document lies in the particular range corresponding to the background density is determined (step S45). In the illustrative embodiment, if the output voltage of the document image sensor 30 is lower than 1 V, the density of the leading edge portion of the document is determined to lie in the particular range and is used to form the latent image of a background pattern as will be described. If the answer of the step S45 is NO, the program jumps to a copying procedure without effecting the correction which uses a background pattern. If the answer of the step S45 is YES, successive steps S46 to S50 are executed in the same manner as in FIG. 6 in order to determine the mean value of reference voltages V'sg.

Subsequently, the reference bias voltage of 50 V is increased by 30 V which corresponds to half a notch (step S51). In this condition, the document is illuminated over 40 millimeters as measured from the leading edge thereof (step S52). The resultant latent image is developed under the application of a bias voltage of 80 V, i.e. 50 V+30 V. The dimension of 40 millimeters mentioned above is derived from the accuracy of detection attainable with the document density sensor 30. This is followed by the same sequence of steps (S53 to S57) as those shown in FIG. 6.

In summary, in accordance with the present invention, a light pattern is provided independently of a reference density pattern to serve as a background pattern having a low density. The light pattern is illuminated to electrostatically form a latent image thereof on a photoconductive element. After the latent image has been developed by a toner, the density of the resultant toner image is sensed by an image density sensor. Such a procedure is successful in detecting a change in background density ascribable to contamination, increase in background potential, etc. The amount of light for illumination or similar factor which governs the developing ability is corrected on the basis of the detected change in background density. For example, when the background density has been shifted to the dark side, the factor of interest is controlled in such a manner as to control the background density to the light side until an adequate density matching the current image notch or the like has been set up. When a leading edge portion of a document has a density corresponding to the background density, it is used in place of the light pattern. In such a case, the image of a background pattern can be formed under exactly the same conditions as the image of an ordinary document, i.e., and without suffering from strict limitations particular to the light pattern.

Various modifications will become possible for those skilled in the art after receiving the teachings of the present disclosure without departing from the scope thereof.

What is claimed is:

1. An image density control method for an image forming apparatus for illuminating, in an electrophotographic process, a reference density pattern having a reference density to electrostatically form a latent image of said reference density pattern on a uniformly charged photoconductive element, developing said latent image by a toner-containing two-component developer to form a toner image, optically sensing a density of said toner image, and controlling a developing ability on the basis of said detected density to maintain the developing ability constant, said method comprising the steps of:

(a) providing said reference density pattern and a background pattern having a low density at opposite sides of a same scanning line which lies in a scanning range of said scanner so that said reference density pattern is illuminated prior to a document scanned by said scanner and said background pattern is illuminated when one of a power source of said apparatus is turned on, a predetermined period of time has passed since said apparatus has been turned on and a user enters a command;

(b) electrostatically forming on said photoconductive element a latent image representative of a background pattern whose density corresponds to a background density of a document image;

(c) developing said latent image of said background pattern by the developer to form a toner image;

(d) optically sensing a density of said toner image associated with said background pattern;

(e) detecting a change in the background density in response to said sensed density of said toner image associated with said background pattern; and (f) correcting the developing ability in response to said detected change in the background density.

2. A method as claimed in claim 1, wherein step (a) comprises (g) providing said reference density pattern at a home position side of said scanner, and (h) providing said background pattern at a return position side of said scanner.

3. A method as claimed in claim 1, wherein a position where said background pattern is located is remote from an image fixing section of said image forming apparatus.

4. A method as claimed in claim 1, wherein the background pattern is illuminated only when one of the power source of the apparatus has been turned on, the predetermined period has passed and the user enters a command for illuminating the background pattern.

5. An image density control method for an image forming apparatus for illuminating, in an electrophotographic process, a reference density pattern having a reference density to electrostatically form a latent image of said reference density pattern, developing said latent image by a toner-containing two-component developer to form a toner image, optically sensing a density of said toner image, and controlling a developing ability on the basis of said detected density to maintain the developing ability constant, said method comprising the steps of:

(a) providing a document image density sensor for sensing a density of a document image;

(b) sensing a density of a leading edge portion of a document image by said document image density sensor;

(c) determining whether or not said sensed density of said leading edge portion of said document image corresponds to a background density;

(d) illuminating, if said sensed density corresponds to the background density, said leading edge portion by said scanner to electrostatically form a latent image of said leading edge portion on said photoconductive element.

(e) developing said latent image of said background pattern by the developer to form a toner image;

(f) optically sensing a density of said toner image associated with said background pattern;

(g) detecting a change in the background density in response to said sensed density of said toner image associated with said background pattern; and (h) correcting the developing ability in response to said detected change in the background density.

6. A method as claimed in claim 5, wherein step (d) comprises (i) illuminating said leading edge portion of said document image over 40 millimeters as measured from a leading edge of said document image by said scanner.

* * * * *